US006052985A

United States Patent [19]

Ballhausen et al.

[11] Patent Number: 6,052,985

[45] Date of Patent: Apr. 25, 2000

[54] DEVICE FOR PRODUCING A TWISTED YARN IN A COMBINED SPINNING AND TWISTING PROCESS

[75] Inventors: Ulrich Ballhausen, Krefeld; Guido Spix, Kaarst, both of Germany

[73] Assignee: Volkmann GmbH & Co., Germany

[21] Appl. No.: 09/149,384

[22] Filed: Sep. 8, 1998

[30] Foreign Application Priority Data

Sep. 8, 1997 [DE] Germany ..... 197 39 282

[51] Int. Cl.[7] ..... D01H 4/00

[52] U.S. Cl. ..... 57/404; 57/406; 57/409; 57/58.49; 57/58.52

[58] Field of Search ..... 57/404, 406, 409, 57/417, 58.49, 58.52

[56] References Cited

U.S. PATENT DOCUMENTS

| | | | |
|---|---|---|---|
| 5,479,771 | 1/1996 | Ballhausen et al. | 57/406 |
| 5,499,496 | 3/1996 | Stenmans | 57/406 |
| 5,605,037 | 2/1997 | Ballhausen et al. | 57/406 |
| 5,632,140 | 5/1997 | Ballhausen et al. | 57/409 |

FOREIGN PATENT DOCUMENTS

| | | |
|---|---|---|
| 1901453 | 8/1970 | Germany . |
| 4331801 | 9/1993 | Germany . |
| 4411293 | 10/1995 | Germany . |

*Primary Examiner*—William Stryjewski
*Attorney, Agent, or Firm*—Robert W. Becker & Associates

[57] ABSTRACT

A device for producing a twisted yarn in a combined spinning and twisting process has two open end spinning rotors positioned in a stationary protective pot, a hollow spindle axle into which the spun yarns produced by the spinning rotors are introduced, and a yarn guide channel extending radially from the spindle axle and driven in rotation about the spindle axis for guiding the yarn formed by the spun yarns. The yarn exits from the yarn guide channel and is guided external to the protective pot counter to the guiding direction within the spindle axle to a centering point positioned on an extension of the spindle axle. A device for supplying a dissolved fiber material to the two open end spinning rotors is provided. Two slide bearings for supporting the spinning rotor shafts, an electric motor with a drive member resting at the spinning rotor shafts, and for each spinning rotor two guide rollers are arranged within the protective pot. Each pair of guide rollers forms a wedge-shaped gap in which the respective spinning rotor shaft rests. For each spinning rotor shaft the rotational axes of the motor and of the correlated guide rollers determine an isosceles triangle, whereby the bisecting line intercepting the rotational axis of the motor is positioned within the center plane of the wedge-shaped gap.

15 Claims, 2 Drawing Sheets

DEVICE FOR PRODUCING A TWISTED YARN IN A COMBINED SPINNING AND TWISTING PROCESS

BACKGROUND OF THE INVENTION

The invention relates to a device for producing a twisted yarn in a combined spinning and twisting process. Two open end spinning rotors are arranged in a stationary protective pot. A hollow spindle axle is provided into which the spun yarns produced by the open end spinning rotors are introduced and to which is connected a radially extending yarn guide channel rotatably driven about the spindle axis for guiding the two spun yarns forming the yarn. The yarn, after exiting from the yarn guide channel, is removed external to the stationary protective pot by a winding device counter to the direction of movement within the hollow spindle axle to a centering point positioned on an extension of the hollow spindle axle. A device for supplying dissolved fiber material to the two open end spinning rotors is also provided.

In a device of the aforementioned kind, disclosed in DE 43 31 801 C1, the drive of the open end spinning rotors is provided by a common drive motor and a belt drive, or, according to DE 44 11 293 C2 by an individual electric motor drive for each spinning rotor.

It is an object of the invention provide a device of the aforementioned kind with a drive system that is simplified in its construction and reliable in its function.

SUMMARY OF THE INVENTION

The desired simplification is achieved basically in that the two spinning rotor shafts are supported by slide bearings and are driven by a single drive motor and its drive member. Due to the special arrangement of the individual rotational axes, each spinning rotor shaft rests at the respective guide rollers and at the drive member and thus is supported securely for high rpm.

In German patent 19 01 453 C3 a support for a spinning rotor is disclosed having a shaft supported axially at a slide bearing and driven by a tangential belt. It is supported in the radial direction in a wedge-shaped gap formed by guide rollers and is loaded by an axial force acting in the direction of the slide bearing and generated by positioning the axis of the guide rollers at a slant relative to one another.

By having at least one of the rotational axes, i.e., of the electric motor and/or of the individual spinning rotor shafts and/or of at least one of the two guide rollers of each spinning rotor shaft, slanted relative to at least one other of these rotational axes such that the individual spinning rotor shaft is loaded by an axial force in the axial direction against the slide bearing, two spinning rotors, directly driven by a common motor, are provided with a reliable support of the spinning rotor shafts.

BRIEF DESCRIPTION OF THE DRAWINGS

The invention will be disclosed on the following in more detail with the aid of the drawings.

DESCRIPTION OF PREFERRED EMBODIMENTS

Figure 1:
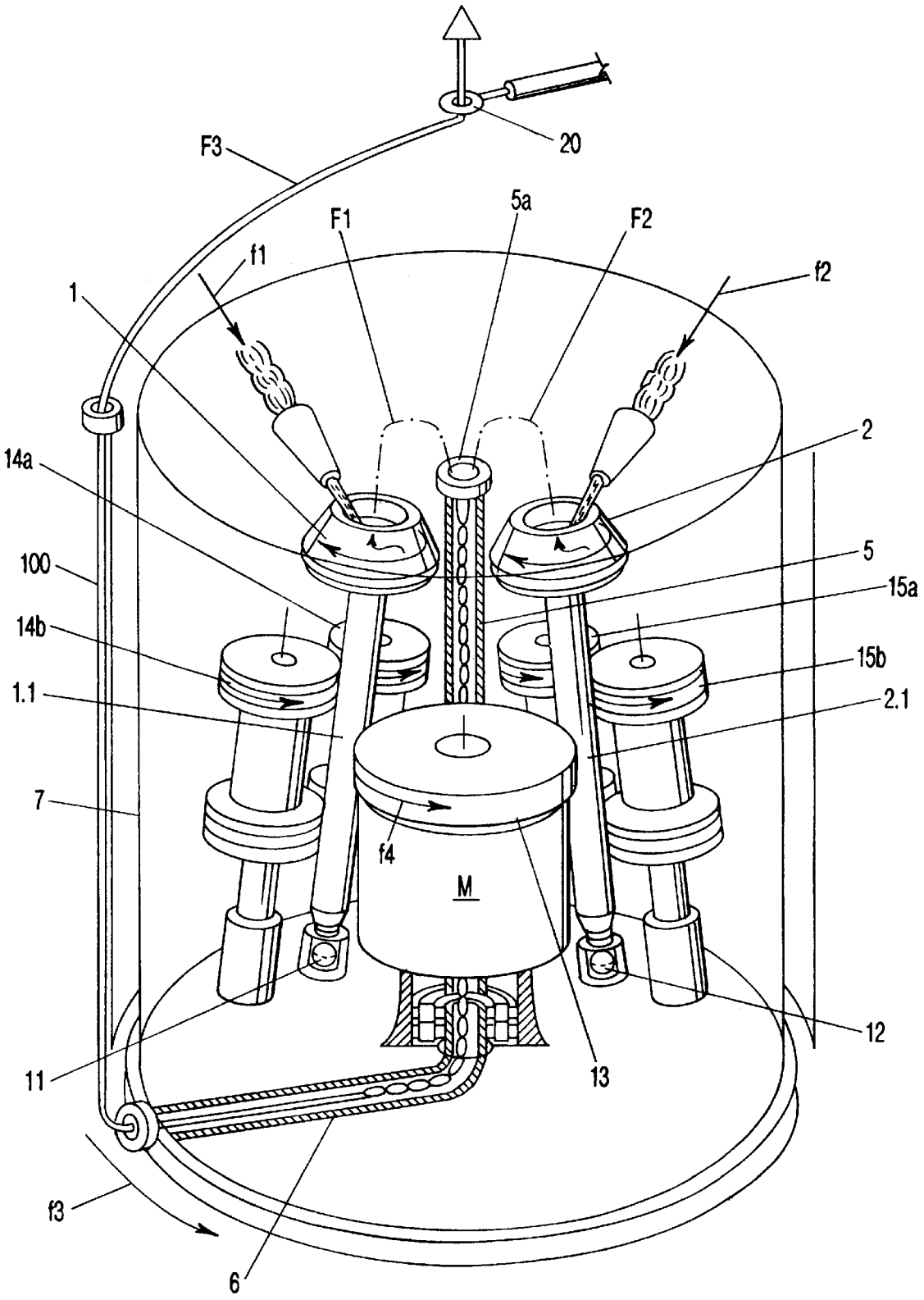
FIG. 1 shows in a schematic representation the method steps of an open end spinning two-for-one twisting process as well as the drive and support of the open end spinning rotors.

Substantially in conformity with the known device disclosed in German patent 43 31 801 C1 for producing a twisted yarn in an integrated spinning and twisting process, the schematic representation of FIG. 1 shows open end spinning rotors 1 and 2 arranged directly adjacent to one another and driven by a motor M. Dissolved fiber material is supplied in the direction of arrows f1 and f2 through fiber material feed tubes 3 and 4 to the rotors.

The two spun yarns F1 and F2 produced in the spinning rotors and removed in the upward direction according to the conventional open end method are combined with one another in the area of the upper inlet opening 5*a* of the hollow spindle axle 5, are guided in the axial direction downwardly through the hollow spindle axle 5, are then guided radially outwardly through the yarn guide channel 6, rotatingly driven about the spindle axis in the direction of arrow f3, before they are moved in the upper direction while encircling the protective part 7 in which the two spinning rotors 1 and 2 are received. They are then gathered at the centering point Z that is in the form of a yarn guide eye 20 and is positioned on an extension of the hollow spindle axle and are guided to a feeding device 8. This winding device comprises two feed rollers 8.1 and 8.2 whereby one is driven by motor 8.3. Downstream of this feeding device 8 the twisted yarn is guided by two guide rollers 9 and 10 to a conventional reciprocating yarn guide/winding device B. One of the guide rollers is pivotably supported against a spring force in order to provide a yarn length compensation device.

Figure 2:
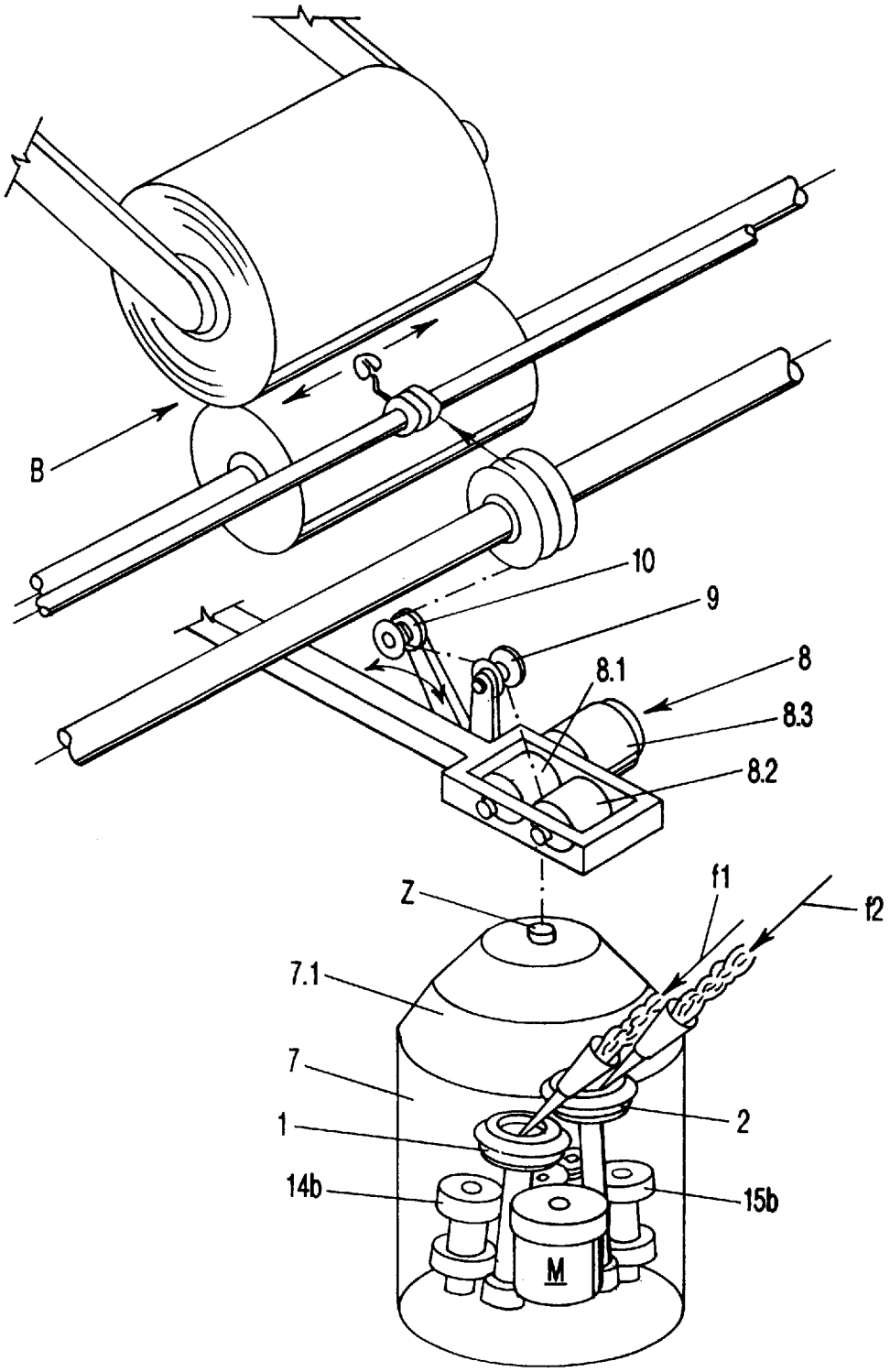
FIG. 2 shows in a schematic representation a view of the device for producing a twisted yarn in a combined spinning and twisting process.

According to FIG. 2, the protective 7 can be provided with a protective pot lid 7.1 having a yarn outlet opening that functions as the centering point Z.

According to FIG. 1, the yarn guided in the radial direction through the yarn guide channel 6 is forcibly guided downstream thereof by an axially extending, rotatably driven yarn guide channel 100 before it is guided in the form of a yarn balloon to the centering point Z. As an alternative, it is also possible to allow the yarn to freely rotate as a balloon about the protective pot 7. According to FIG. 1 the two shafts 1.1 and 2.1 of the spinning rotors 1 and 2 within the stationary protective pot 7 are supported by two slide bearings 11 and 12. The electric drive motor M, which is also supported in a suitable manner within the protective pot 7, drives in the direction of arrow f4 a drive member, preferably a friction wheel 13 that rests on both spinning rotor shafts 1.1 and 2.1 for driving both open end spinning rotors 1 and 2. Each open end spinning rotor 1 and 2 has coordinated therewith two guide rollers 14*a*, 14*b* and 15*a*, 15*b* which are preferably coated with an elastic material and supported in the protective pot. They respectively define a wedge-shaped gap in which the respective spinning rotor shaft 1.1 and 2.1 rests at the guide rollers.

For each spinning rotor shaft the rotational axis of the motor M and of the correlated guide rollers 14*a*, 14*b* and 15*a*, 15*b* an isosceles triangle is formed whereby the bisecting line intercepting the rotational axis of the motor M intercepts the central plane of the wedge-shaped gap.

The rotational axis of the two rotor shafts 1.1 and 2.1 and of the guide rollers 14*a*, 14*b* and 15*a*, 15*b* in the drawing are positioned at a slant relative to the hollow spindle axle 5, respectively, the axis of the motor M whereby the respective slant is selected such that the individual spinning rotor shafts 1.1 and 2.1 are loaded by an axial force toward the slide bearing 11 and 12.

In order to achieve this goal, it is, in general, sufficient that at least one of the rotational axes of the spinning rotor shafts 1.1, 2.1 and/or at least one of the two guide rollers 14*a*, 14*b* and 15*a*, 15*b* of each spinning rotor shaft and/or of the motor M are slanted relative to at least one other of these rotational axes.

For facilitating assembly, the electric motor M and/or at least one of the two guide rollers of each spinning rotor shaft can preferably be removable against a spring force from the individual spinning rotor shaft.

Preferably, the diameter of the guide rollers 14*a*, 14*b*, and 15*a*, 15*b* is at least 2.5 times greater than the diameter of the spinning rotor shafts. The diameter of the drive member, respectively, friction wheel 13 is preferably substantially greater than the sum of the axial spacing of the spinning rotor shafts and the diameter of one spinning rotor shaft. A circle circumscribing all of the guide rollers, the two spinning rollers, and the motor is preferably at most equal to the sum of twice the outer diameter of the open end spinning rotors plus 10 mm, when viewed in a plan view.

The specification incorporates by reference the disclosure of German priority document 197 39 282.2 of Sep. 8, 1997.

The present invention is, of course, in no way restricted to the specific disclosure of the specification and drawings, but also encompasses any modifications within the scope of the appended claims.

What is claimed is:

1. A device for manufacturing a twisted yarn by a combined spinning and twisting process, said device comprising:

a stationary protective pot (7) having a central axis;

two open end spinning rotors (1, 2) each having a rotor shaft (1.1, 2.2) with a shaft axis;

two slide bearings (11, 12) mounted in said protective pot (7), wherein each one of said rotor shafts (1.2, 2.1) is mounted in one of said slide bearings (11, 12);

a device for feeding dissolved fiber material to said open end spinning rotors (1, 2), wherein the fiber material is spun by said open end spinning rotors to form spun yarns;

a hollow spindle axle (5) extending centrally through said protective pot (7) on said central axis;

said hollow spindle axle (5) having an upper end and a lower end;

a radially extending yarn guide channel (6) communicating with said lower end of said hollow spindle axle (5) and rotatably driven about said central axis;

said yarn guide channel (6) having an outlet external to said protective pot (7), wherein spun yarns produced by said two open end spinning rotors (1, 2) are introduced into said upper end of said hollow spindle axle (5) and exit as a twisted yarn from said outlet of said yarn guide channel (6);

a centering point (Z) located above said hollow spindle axle (5);

a winding device (B) mounted external to said protective pot (7), wherein the twisted yarn is removed from said outlet of said yarn guide channel (6) in a direction opposite to the direction of feeding through said hollow spindle axle (5) to said centering point (Z);

an electric motor (M) having a drive member (13) resting at said rotor shafts (1.1, 1.2);

a pair of guide rollers (14*a*, 14*b*; 15*a*, 15*b*) for each one of said rotor shafts (1.1, 2.1), wherein each one of said pairs of guide rollers (14*a*, 14*b*, 15*a*, 15*b*) forms a wedge-shaped gap in which said rotor shaft (1.2, 2.1) rests, respectively;

wherein each one of said pairs of guide rollers (14*a*, 14*b*, 15*a*, 15*b*) is arranged relative to said motor (M) such that in a view from said centering point (Z) onto said protective pot (7) rotational axes of each one of said pair of guide rollers and said motor define corners of an isosceles triangle, wherein said triangle has a bisecting line intercepting the rotational axis of said motor and a center plane of said wedge-shaped gap.

2. A device according to claim 1, wherein at least one of said rotational axes and said shaft axes is positioned relative to another one of said rotational axes and said shaft axes at a slant such that each one of said shaft axes is subjected to an axial force acting in a direction toward said slide bearings (11, 12).

3. A device according to claim 2, wherein, relative to said central axis, only said shaft axes are positioned at a slant.

4. A device according to claim 2, wherein, relative to said central axis, only at least one of said rotational axes of said guide rollers of each one of said pairs of guide rollers is positioned at a slant.

5. A device according to claim 4, wherein said rotational axes of said guide rollers of each one of said pairs of guide rollers are slanted relative to one another.

6. A device according to claim 1, wherein said electric motor (M) comprises a release for removing said drive member (13) from said rotor shafts (1.1, 2.1).

7. A device according to claim 1, wherein said electric motor is biased by a spring force against said rotor shafts (1.1, 2.1).

8. A device according to claim 1, wherein at least one of said guide rollers (14*a*, 14*b*, 15*a*, 15*b*) of each one of said pairs of guide rollers comprises a release for removing said at least one guide roller (14*a*, 14*b*, 15*a*, 15*b*) from said rotor shaft (1.1, 2.1).

9. A device according to claim 1, wherein at least one of said guide rollers (14*a*, 14*b*, 15*a*, 15*b*) of each one of said pairs of guide rollers is biased by a spring force against said rotor shaft (1.1, 2.1).

10. A device according to claim 1, wherein, relative to said central axis, only said rotational axis of said drive member (13) of said motor (M) is positioned at a slant.

11. A device according to claim 1, wherein said drive member (13) is a friction wheel.

12. A device according to claim 11, wherein said friction wheel (13) has a diameter that is greater than a sum of a spacing between said rotor shafts (1.1, 2.1) and a diameter of said rotor shafts (1.2, 2.1).

13. A device according to claim 1, wherein said guide rollers (14*a*, 14*b*, 15*a*, 15*b*) have a diameter that is at least 2.5 times greater than a diameter of said rotor shafts (1.1, 2.1).

14. A device according to claim 1, wherein said guide rollers (14*a*, 14*b*, 15*a*, 15*b*) have an elastic coating.

15. A device according to claim 1, wherein a circle circumscribing said guide rollers (14*a*, 14*b*, 15*a*, 15*b*), said open end spinning rotors (1, 2), and said electric motor (M) in a plan view is equal to or less than a sum of twice an outer diameter of said open end spinning rotors (1, 2) plus 10 mm.

* * * * *